US005172494A

United States Patent [19]

Davidson

[11] Patent Number: 5,172,494

[45] Date of Patent: Dec. 22, 1992

[54] FOOT CUSHIONING DEVICE

[76] Inventor: Murray R. Davidson, P.O. Box 759, San Marcos, Calif. 92069

[21] Appl. No.: 708,238

[22] Filed: May 31, 1991

[51] Int. Cl.[5] ..... A43B 7/32; A43B 21/32

[52] U.S. Cl. ..... 36/35 R; 36/69; 36/37; 36/71; 36/173

[58] Field of Search ..... 36/35 R, 37, 69, 71, 36/129, 43; 128/581, 614

[56] References Cited

U.S. PATENT DOCUMENTS

| | | | |
|---|---|---|---|
| 456,677 | 7/1891 | McIntyre | 36/37 |
| 832,375 | 10/1906 | Gordon | 36/37 |
| 3,641,688 | 2/1972 | von den Benken | 36/43 |
| 4,120,102 | 10/1978 | Kenigson | 36/37 |
| 4,179,826 | 12/1979 | Davidson | 36/37 |
| 4,398,357 | 8/1983 | Batra | 36/129 |
| 4,776,109 | 10/1988 | Sacre | 36/37 |
| 4,974,343 | 12/1990 | Davidson | 36/37 |

FOREIGN PATENT DOCUMENTS 29361 of 1911 United Kingdom ..... 36/37

*Primary Examiner*—Paul T. Sewell
*Assistant Examiner*—Marie D. Patterson
*Attorney, Agent, or Firm*—Gregory J. Nelson

[57] ABSTRACT

A foot cushioning device to absorb shock primarily shock due to heel strike which device is insertable in or may be incorporated in footwear. The exterior of the body of the device carries primary shock absorbers extending at least from the portion of the device in the heel area. The primary shock absorber deforms to protect the foot by absorbing initial shock loads. Secondary shock absorbers are also provided which with increased deformation will provide resistance to higher shock load so that a non-linear force displacement behavior similar to that occurring in the natural heel pad occurs. In the preferred embodiment, the body of the device is a heel cup and the primary and secondary shock absorbing members are defined by longer and shorter ribs extending longitudinally and transversely along the outer surface of the heel cup in a grid-like pattern.

7 Claims, 2 Drawing Sheets

FOOT CUSHIONING DEVICE

BACKGROUND OF THE INVENTION

The present invention relates to a foot cushioning device and more particularly relates to a foot cushioning device which has associated shock absorbing structure to absorb and relieve shock imposed on the foot, particularly in the heel area.

Running for health and fitness has increased in popularity in the last ten years. Persons of all ages run both recreationally, for fitness and in competition at different levels. With the increased emphasis on competitive running, runners and joggers have had to increase the intensity of their training by running greater distances. Serious competitive runners preparing for an event such as a marathon commonly run as many as seventy miles a week or more. Even those who run for recreation and fitness may run substantial distances each week. Accompanying this increased activity is a greater risk of injuries due to over use. Many of these are degenerative disorders which occur in the lower extremities due to the shock imposed on the body.

It has been estimated that as many as forty million Americans participate in some form of running. Statistics indicate that 50% to 70% of these individuals will suffer from some type of running-related injury. For example, running twenty miles a week for a period of thirty years will result in the body being subjected as many as fifty million shock waves.

Shock waves are due to external forces. Some of them are produced by constraints such as the running surface, sport equipment. In walking, running, jogging or jumping, the ground reaction force is the most important external force. The magnitude of the ground reaction force, its direction and point of application have an influence on the loads imposed on the body. Ground reaction force, both magnitude and direction and point of application depend upon a number of factors. Various devices can be found in the prior art to absorb the impact and shock forces imposed on the foot, particularly the heel. Generally these devices are orthopedic devices which serve to alleviate conditions such as shock and serve to maintain the heel and the foot in the proper anatomical attitude to prevent the tendency of the foot to pronate. Some running shoes incorporate shock absorbers and also provide stability of motion control for the runner. To satisfy these requirements, some compromise generally has to be made by the shoe manufacturer. Thus, it becomes increasingly important to supplement the built-in shock absorbing capacity of the footwear with additional shock absorbing capacity which can be provided by a specially built heel cup or similar device.

One such auxiliary shock absorbing device which is intended to be inserted in some type of footwear is shown in my prior patent, U.S. Pat. No. 4,619,055. This patent discloses a cushioning pad or mat which is insertable in footwear having an upper laminae of material having moisture absorbing characteristics with an intermediate laminae and a lower cushioning pad. When used as an insole, the device is provided with various sizes and shapes for insertion in shoes. Air holes are provided at spaced intervals and a special cellular design provides a bellows action to enhance flow of air around and through the insole and also serves to improve blood circulation to the extremities of the user.

Another foot cushioning device is also shown in my prior patent, U.S. Pat. No. 4,179,826. This device which has achieved considerable success is sold under the trademark TULI'S and has a body defining a cup-like recess to receive at least the heel or os calcis portion of the foot. The device is insertable in ordinary footwear. The exterior of the heel cup body is provided with shock absorbing projections extending from at least the rear of the heel portion at the underside of the foot. The projections deform and deflect to protect the foot by absorbing shock forces on the weight-bearing portions of the foot.

U.S. Pat. No. 4,974,343 shows a unique foot cushioning device which has a heel cup to fit over the heel of the wearer which is attached to an elastic anklet. The anklet is preferably constructed of an expandable elastic material and serves to support the ankle area of the user and to secure the shock absorbing heel cup in the proper position. The device provides a complete foot appliance which controls the pronation and supination of the heel and stabilizes the ankle.

While, as indicated above, the aforementioned devices are representative of the prior art and have achieved considerable commercial success and are of significant help to many users, there nevertheless exists a need in many instances for an improved shock absorber which effectively simulates the biomechanical behavior of the human heel pad.

The present invention provides a novel and unique foot cushioning device which in a preferred embodiment includes a heel cup portion designed to fit over at least a portion of the heel of the wearer in the area of the os calcis. The exterior of the cushioning device beneath the heel bone is provided with projecting shock absorbing members. The shock absorbing members are configured to simulate the physiological behavior of the human heel pad and in the preferred embodiment are configured as a plurality of interconnecting longitudinal and transverse ribs of varying height. When the taller ribs begin to collapse there is relatively low resistance deformation. With the increase in global deformation, the taller ribs collapse the length of the shorter ones and at this point both the taller and shorter ribs provide resistance to load resulting in a non-linear force displacement behavior similar to that which occurs with the human heel pad. The shock absorbing members may be also provided in other various configurations such as cylindrical projections of varying length. In the preferred embodiment, the device is adapted to be worn in the shoe and the shock absorber arranged on a cup-shaped body. The medial and lateral sides of the cup conform to the appliance to the heel seat of a shoe so the device can be conveniently inserted in a conventional shoe. The device is formed and preferably molded from any relatively soft flexible material such as natural or synthetic rubber or other suitable thermoplastic material.

In other embodiments, the device may be formed simply as a generally planar insole or the design can be incorporated into the heel or insole portion of an athletic shoe.

The above and other objects and advantages of the present invention will become more apparent from the following specification, claims and drawings in which:

Figure 5:
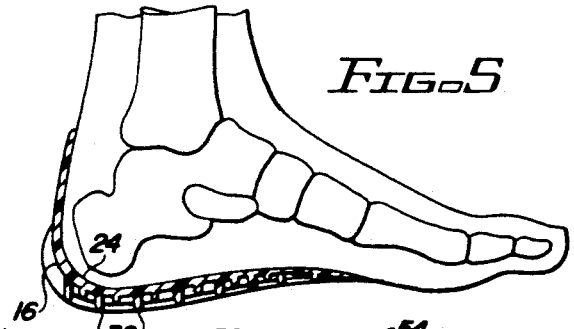
FIG. 5 is an elevational view showing the device in FIG. 1 in section and in position in relationship to the bone structure of the foot and applied to the foot of the wearer.

The present invention relates to a cushioning or shock absorbing device, a preferred embodiment which is shown in FIGS. 1 to 6 and is generally designated by the numeral 10. Shock absorbing device 10 is configured to snugly fit about the heel of the user as shown in FIG. 5 and is preferably molded as an integral part from an appropriate and light weight and deformable shock absorbing material such as natural latex rubber, neoprene or a low density thermoplastic material such as polypropylene or polyethylene. The particular material may vary but the principal characteristic required of the material is that the material should be resilient and have memory so that after the material is deformed under load and the load released, the material will return to its orginal shape and position.

The device 10 is formed as an integral body with a cup portion 11 having opposite medial wall 12 and lateral side wall 14. The cup is shaped so as to fit on either foot of the user. The side walls are interconnected by transversely extending platform 16. The heel-receiving cup 11 is completed by generally vertical rear wall 18 which interconnects the side walls and also connects the with platform 16 at curved heel seat 24. Shock absorbers 25 are provided on the exterior surface of the body. As best seen in FIGS. 1 to 4, the primary shock absorber consists of a plurality of spaced apart parallel ribs 30 extending longitudinally along the underside of the heel cup and at least partially extending upwardly along the exterior of the rear wall of the heel cup. Preferably, the depth of the ribs vary having maximum depth in the heel area in the area of the heel recess and tapering to the exterior surface of the heel cup at either end. The number and spacing of the longitudinal ribs may vary but the ribs should be provided at spaced apart intervals the full width of the os calcis. In practice, the depth of the first ribs at maximum would be approximately 0.2 to 1 cm. and would be spaced approximately apart 1 cm.

The exterior primary shock absorbers are completed by a plurality of spaced apart transversely extending ribs 36 which intersect and are connected to the longitudinal ribs 30 at spaced intervals forming a plurality of generally rectangular shock absorbing sections. The transverse ribs 36 are provided in at least the area beneath the heel and preferably extend forwardly along the underside of the heel cup section. The transverse ribs are configured having an overall depth or height corresponding to that of the longitudinal ribs and in the area beneath the heel would typically be approximately 0.75 cm. in depth. It will be seen that the primary shock absorbers form a plurality of interconnected rectilinear sections 32 which when viewed in FIG. 3 may be described as having a general grid-like appearance or configuration.

As indicated above, the function of the foot cushion of the present invention is to simulate the behavior of the natural shock absorber, the human heel pad. To simulate such behavior, the present design is provided with secondary shock absorbers. The overall design of the cushioning device provides relatively little resistance at the beginning of deformation with the resistance being gradually and non-linearly increased with increase of load. To accomplish this, the secondary shock absorbers consists of a plurality of spaced-apart, parallel ribs 30A which extend longitudinally along the bottom side of the platform and partway upwardly along the rear wall of the heel cup interposed between ribs 30. Preferably, the depth of the ribs 30A are approximately one-half the depth of ribs 30 and similarly have a maximum height in the area of the heel recess and taper at either end.

Transverse ribs 36A intersect the longitudinal ribs 30A at spaced apart intervals and are preferably spaced intermediate transverse ribs 30. Similarly, the longitudinal ribs 30A are spaced intermediate longitudinal ribs 30 so that smaller, generally rectilinear shock absorber sections 32A are defined within each of the larger rectilinear sections 32 defined by the transverse ribs 30 and longitudinal ribs 28.

Figure 6:
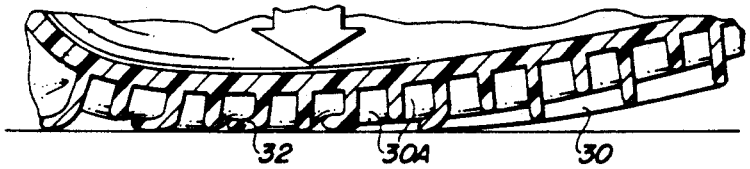
FIG. 6 is a partial sectional view illustrating the initial deformation that occurs upon impact.
Figure 8:
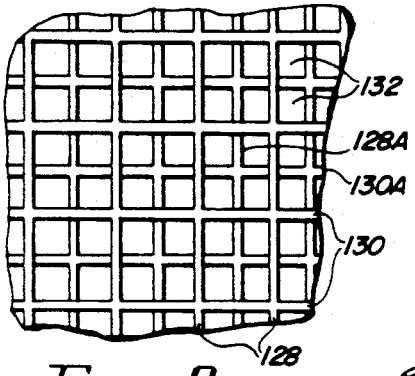
FIG. 8 is a detail view of the shock absorbing structure applied to a footwear insole as indicated in FIG. 7.
Figure 11:
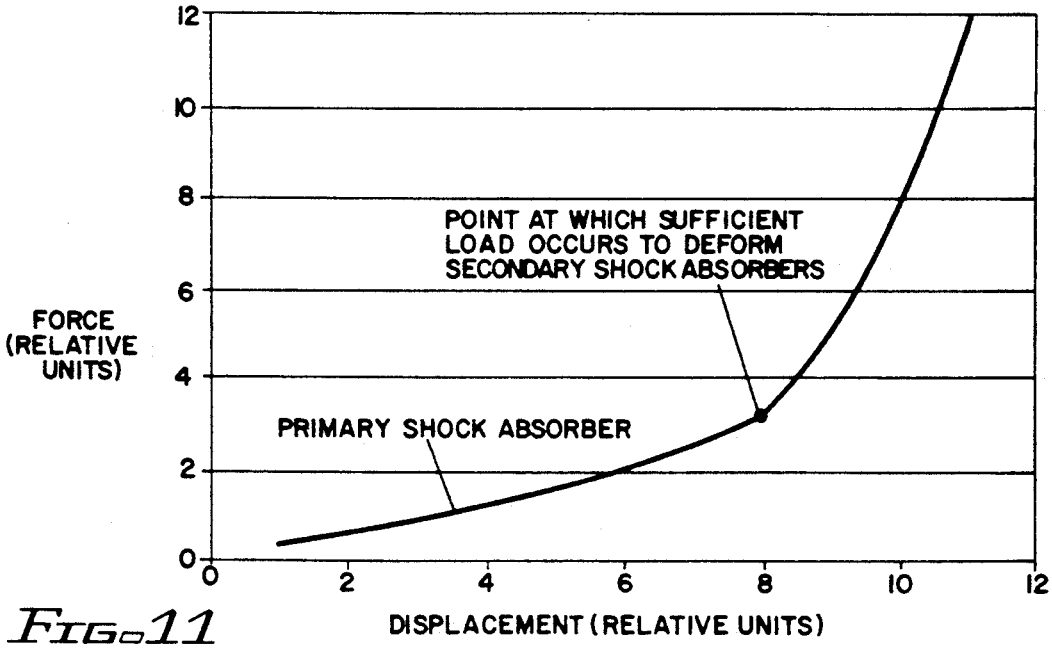
FIG. 11 is a force deformation in diagram illustrating the relative displacement of the device upon application of force.

Referring to the force deformation diagram FIG. 11, it is seen that at the beginning of displacement (0–6 units) of the shock absorber relatively small load increasing will cause deformation. Thereafter, a small increase in deformation (from 8–10 units) results only from a relatively large increase in force. When the cushioning device of the present invention first touches the ground, the longer ribs 28, 30, first begin to collapse. Since their stiffness is less than that of the shorter ribs 28A, 30A, there is relatively low resistance to deformation. With increase of global deformation, the taller ribs collapse to the height of the shorter ribs at which point both sets of ribs begin to provide resistance to the load. This condition is shown in FIG. 6 illustrating the point at which the shorter shock absorbing ribs begin to provide resistance. Since the stiffness of the shorter ribs is greater than that of the longer ribs due to their length and the gating effect due to their interconnection, a non-linear force displacement very similar to that which occurs to the natural heel pad tissue occurs.

In use, device 10 is positioned in the heel section of suitable footwear and the wearer's foot inserted as shown in FIG. 5. Shock forces imparted during walking, running or jogging are absorbed by deflection and deformation of cooperative primary and secondary shock absorber sections 32 and 32A which provide a non-linear resistance to force. After deflection and deformation, and release of the load, the ribs will tend to return to their normal non-deflected condition. The non-linear resistance will prevent the shock absorbers from "bottoming out", a condition that will occur with many other foot cushions, particularly those which utilize only a foam cell construction. The primary and secondary ribs also serve to resist pronation and maintain the foot in a stable position.

Figure 1:
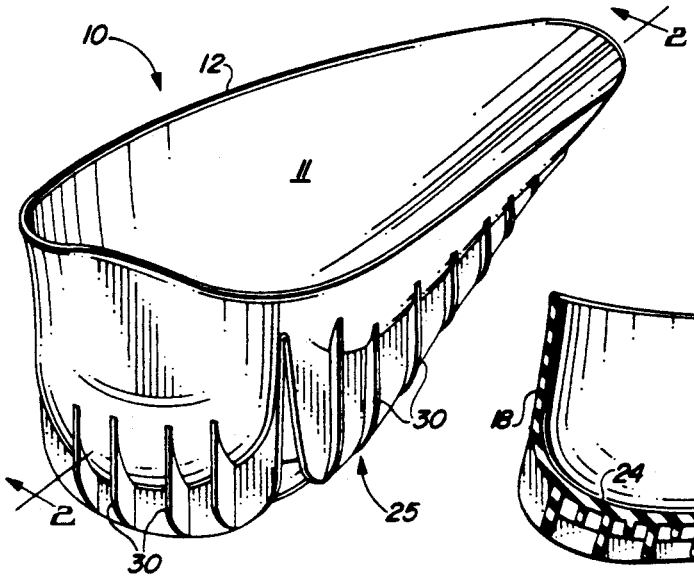
FIG. 1 is a perspective view of the shock absorbing and cushioning device of the present invention designed to be placed about the heel of the user and inserted in footwear.
Figure 2:
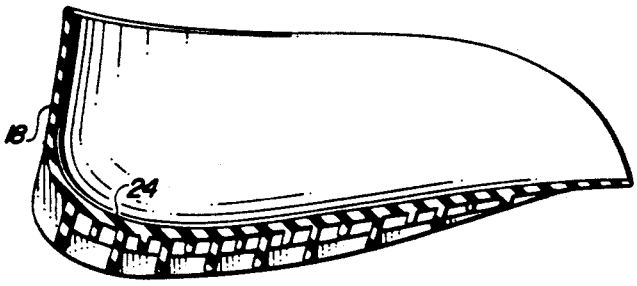
FIG. 2 is a sectional view taken along lines 2—2 of FIG. 1.
Figure 3:
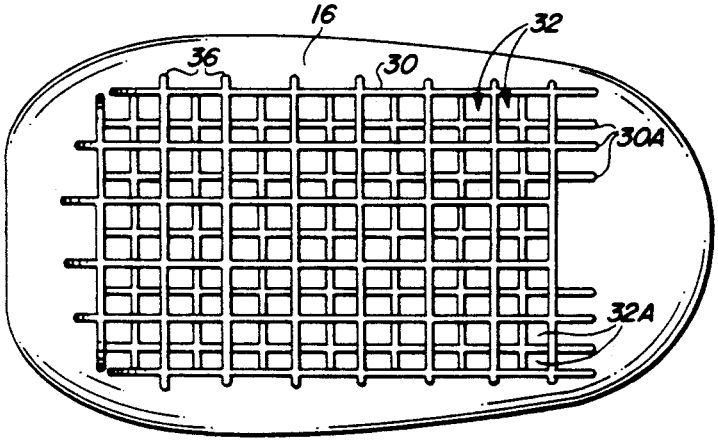
FIG. 3 is a view of the underside of the device shown in FIGS. 1 and 2.
Figure 9A:
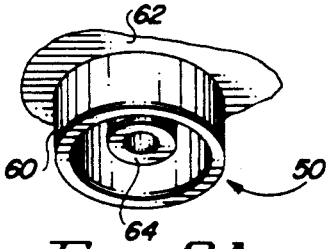
FIG. 9A is a sectional view taken along lines 9A—9A of FIG. 9.
Figure 4:
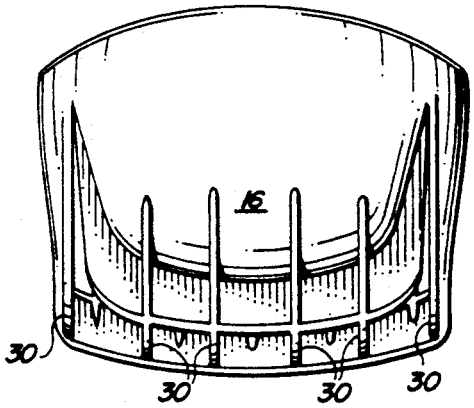
FIG. 4 is a rear view of the device shown in FIGS. 1, 2 and 3.
Figure 9:
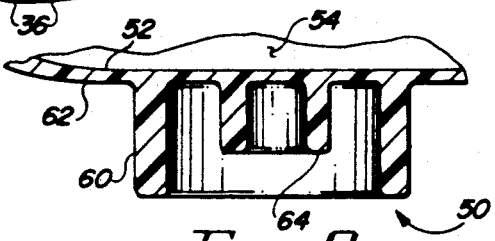
FIG. 9 is a perspective view partially broken away showing still another form of the shock absorbing projections associated with the device.

FIGS. 9 and 9A illustrate another embodiment of the present invention generally designated by the numeral 50. In this embodiment, the integrally molded heel cup or body 52 is formed similar to that shown in previous figures having a central recess or cavity 54 which receives the heel portion of the foot of the wearer. The outer surface of the heel cup carries a plurality of primary shock absorbing and cushioning means 60 which are shown as a plurality of cylindrical projections of resilient material. The projections are located to extend from the exterior 62 of the heel cup at least in the area of the os calcis. The cylinders are integrally formed with the heel cup body and in the area of the os calcis would have a height of approximately 0.5 to 1 cm. Preferably the cylinders are interconnected or closely adjacent and will absorb shock by deflection and deformation of the shock absorbing members.

In order to provide the non-linear force displacement behavior similar to the natural heel pad tissue, a secondary shock absorber 64 is disposed within the cylindrical confines of at least selected of the primary shock absorbers 60. The secondary shock absorbers are shown as small, cylindrical projections extending from the outer surface of the heel cup and having a diameter and height of approximately one-half that of the primary shock absorbers. The wall thickness of the second shock absorbing means may also be selected to be less than that of the first or primary shock absorbing means. In some cases, the secondary shock absorbers may have a disk-like shape in lieu of a cylindrical shape.

Again, the embodiment shown in FIGS. 9 and 9A provide relatively less resistance at the beginning of deformation with resistance being gradual. A non-linear increase occurs with an increase in deformation at the point when the secondary shock absorbers become effective generally in accordance with the force diagram of FIG. 11.

Figure 7:
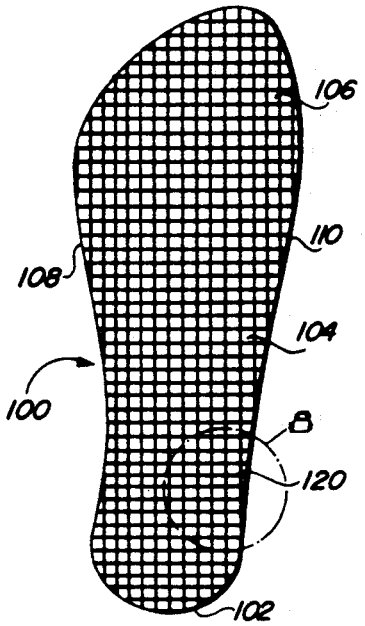
FIG. 7 is a bottom view showing another embodiment of the shock absorber of the present invention as applied to a footwear insole.

FIG. 7 illustrates another embodiment of the shock absorbing device of the present invention which is generally designated by the numeral 100. The cushioning device 100 is adapted to be inserted as an insole in a shoe and includes a heel portion 102, intermediate arch portion 104 and forward portion 106 which is generally is positioned below the metatarsal area of the foot. The cushioning device has opposite lateral and medial sides 108 and 110. Primary shock absorbing sections 120 are provided along all or a part of the underside of the insole and may be of the type described above with reference to any of the preceding figures. For convenience of representation, the primary shock absorbing means are shown as being formed from the longitudinal and transversely extending ribs 128 and 130 extending to form a plurality of generally rectilinear primary shock absorbing section 120.

The secondary shock absorbing means 132 are defined by a transversely and longitudinally extending ribs 128A, 130A interposed intermediate the primary ribs also forming a plurality of smaller generally rectilinear shock absorbing members which are of lesser depth than the primary members. The cushioning or shock absorbing sections 130, 132 are in other respects substantially similar to those described above with reference to prior figures and drawings.

Figure 10:
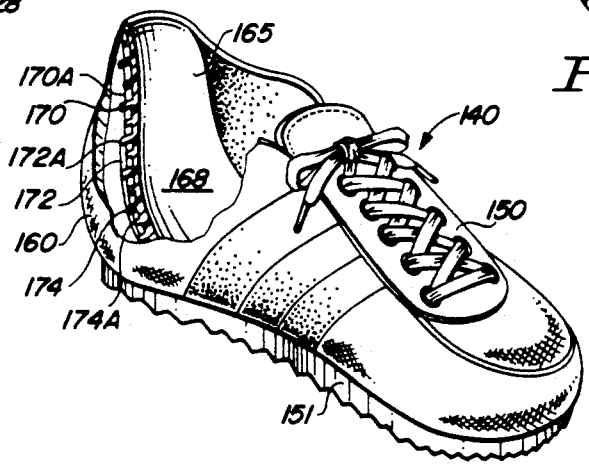
FIG. 10 is a perspective view of an athletic shoe, broken away showing the incorporation of the cushioning device of the present invention as an integral part of the shoe.

FIG. 10 shows the shock absorbing member of the present invention incorporated as an integral part of footwear 140. Footwear 140 can be a shoe of any type such as athletic or jogging shoes having an upper 150 and a lower 151 joined to the upper. In the heel section 160, cushioning device is integrally formed as part of the heel section and counter of the shoe. The cushioning device again has a body portion 165 defining a cavity or recess 168 for the reception of at least the heel portion of the foot. The outer surface of the cushion is provided with primary and secondary shock absorbing means 170, 170A which may be variously configured as described above and for purposes of representation are shown as having primary longitudinal and transverse ribs 172, 172A intersecting and forming primary shock absorbing means and secondary longitudinal and transverse ribs 174, 174A forming secondary shock absorbing means. As has been explained above, the primary shock absorbing means will collapse providing initial lower resistance to deformation. With increased deformation, the primary means will fully collapse and the secondary shock absorbing means will provide resistance to load so that a non-linear force displacement behavior similar to that occurring in the natural heel pad occurs.

It will be seen from the foregoing that the present invention provides a simple, effective and unique foot cushioning device which tends to closely simulate the shock absorbing condition which naturally occurs. The present invention provides a foot cushioning device displaying non-linear force displacement behavior. The shock absorbing means associated with the device may be of various configuration and shape and it will be understood the present invention is not limited to any particular shape or configuration. Those chosen were selected as being representative for purposes of illustration only.

It will be apparent to those skilled in the art to make various changes, alterations and modifications to the invention described herein to the extent such changes, alterations and modifications do not depart from the spirit and scope of the appended claims. They are intended to be encompassed therein.

I claim:

1. A foot cushioning and shock absorbing device comprising:

(a) a resilient body member having an upper surface and a lower surface, the body member being generally configured to be worn at least on the heel portion of the foot and being receivable in footwear;

(b) primary shock absorbing means extending from the outer surface of the body member at least in an area corresponding to the weight-bearing portion of the heel of the foot, said primary shock absorbing means comprising first and second ribs intersecting and interconnecting to form a plurality of first sections having a predetermined first height which will absorb initial shock loads imposed by the foot by deflection and deformation of said primary shock absorbing means; and (c) secondary shock absorbing means extending from the outer surface of the body, said secondary shock absorbing means comprising third and fourth ribs intersecting and interconnected to one another and connected to at least selected of said first sections, said third and fourth ribs having a predetermined second height less than the first height of said first and second ribs, said secondary shock absorbing means being resilient members providing resistance to loads at predetermined higher loads above said initial loads whereby said primary and secondary shock absorbing means cooperate to absorb shock forces imposed on the foot and exhibit a non-linear force displacement behavior at predetermined load levels.

2. The foot cushioning device of claim 1 wherein said resilient body members and said primary and secondary shock absorbing means are formed as an integrally molded member.

3. The foot cushioning device of claim 1 wherein said resilient body member comprises a heel cup having a medial side, lateral side, bottom and rear walls defining a recess to receive at least the os calcis portion of the heel of the foot.

4. The foot cushioning device of claim 1 wherein said device is formed as an integral part of footwear.

5. The foot cushioning device of claim 1 wherein said device is formed as a footwear insole.

6. The foot cushioning and shock absorbing device of claim 1 wherein said first and second ribs and said third and fourth ribs define a generally grid-like pattern.

7. A foot cushioning and shock absorbing device comprising:

(a) a resilient body member having an upper surface and a lower surface, the body member being generally configured to be worn at least on the heel portion of the foot and being receivable in footwear;

(b) a plurality of primary shock absorbing means extending from the outer surface of the body member at least in an area corresponding to the weight-bearing portion of the heel of the foot, said primary shock absorbing means being interconneccted and defining sections having a predetermined first height which will absorb initial shock loads imposed by the foot by deflection and deformation of said primary shock absorbing means; and (c) secondary shock absorbing means depending from the outer surface of the body associated with said sections, said secondary shock absorbing means being connected to at least selected of said primary shock absorbing means, said secondary shock absorber means having a predetermined second height less than the height of said primary shock absorbing means, said secondary shock absorbing means being resilient members providing resistance to loads at predetermined higher loads above said initial loads whereby said primary and secondary shock absorbing means cooperate to absorb shock forces imposed on the foot and exhibit a non-linear force displacement behavior at predetermined load levels.

* * * * *